US005500115A

United States Patent [19]

Nehm et al.

[11] Patent Number: 5,500,115

[45] Date of Patent: Mar. 19, 1996

[54] FILTERING STRAINER

[75] Inventors: Holger Nehm; Hermann Grether, both of Mullheim, Germany

[73] Assignee: Dieter Wildfang GmbH, Mullheim, Germany

[21] Appl. No.: 314,635

[22] Filed: Sep. 29, 1994

[30] Foreign Application Priority Data

Oct. 1, 1993 [DE] Germany ..... 93 14 925.5 U

[51] Int. Cl.[6] ..... B01D 35/02

[52] U.S. Cl. ..... 210/460; 210/497.3; 428/118

[58] Field of Search ..... 428/116, 118, 428/134, 135; 55/487; 210/459, 460, 462, 497.3

[56] References Cited

U.S. PATENT DOCUMENTS

| | | | |
|---|---|---|---|
| 3,480,148 | 11/1969 | Bryand | 210/497.3 |
| 3,795,180 | 3/1974 | Larsen . | |
| 3,817,390 | 6/1974 | Maruniak et al. | 210/460 |
| 4,157,966 | 6/1979 | Hassall | 210/497.3 |
| 4,814,081 | 3/1989 | Malinowski | 55/529 |
| 4,889,629 | 12/1989 | Jackson | 55/529 |
| 5,350,620 | 9/1994 | Sundet et al. | 55/527 |

FOREIGN PATENT DOCUMENTS

| | | |
|---|---|---|
| 0284763 | 10/1988 | European Pat. Off. . |
| 380264 | 7/1907 | France . |

*Primary Examiner*—Robert A. Dawson
*Assistant Examiner*—W. L. Walker
*Attorney, Agent, or Firm*—Dallett Hoopes

[57] ABSTRACT

A strainer for water outlet fittings which has multiple strainer apertures, which possess approximately equal open hexagonal aperture cross sections. The opposite surfaces of common side walls are approximately parallel to each other. The strainer is characterized by comparatively low noise, high throughput and at the same time good straining and cleaning action.

4 Claims, 1 Drawing Sheet

FILTERING STRAINER

BACKGROUND OF THE INVENTION

The invention concerns a one-piece molded strainer attachment for water outlet fittings and the like. It is formed with a number of flow or strainer apertures.

A strainer attachment of the above mentioned general type is already disclosed in the Dieter Wildfang European patent application 0,284,763 published Oct. 5, 1988. This strainer attachment serves as a protective strainer that prevents dirt particles from clogging the passage openings of downstream components. To this end, the known strainer attachment has a number of strainer apertures, all of which have open rectangular cross sections.

Such strainer attachments are subjected to the water pressure of the inflowing water, high water temperatures and at the same time increased amounts of dirt particles that magnify the resistance to the flow as well. These loads could basically be counteracted by a strengthening of the strainer material. Instead, however, the objective continues to be to construct such strainer attachments with the thinnest walls possible. Thin-walled strainer attachments are preferred over thicker walls which would result in lengthy and sharply defined individual jets, and concomitant increased in noise.

There has been a need to create a strainer attachment of the above described type, which produces the lowest possible noise, large flow throughput, and has good straining or cleaning action.

SUMMARY OF THE INVENTION

According to the invention, which satisfies this need, the strainer attachment has strainer apertures which have approximately equal open hexagonal cross sections, the total open cross section being more than about 40% of the total surface area of the strainer. Additionally, the thickness of the strainer apertures measured along the flow direction is always less than twice the largest size of a strainer aperture, and the opposite faces of common side walls of adjacent strainer apertures are approximately parallel to each other.

The strainer attachment of the invention has a number of strainer apertures with a hexagonal cross section. In such hexagonal cross sections of strainer apertures, the difference between the length of a diagonal line and the distance between two parallel opposing sides is kept comparatively small (as opposed to rectangular strainer apertures) with the result that hexagonal passage openings have excellent throughput rates and constant strainer action.

Because the opposite surfaces of common side walls of adjacent strainer apertures in the strainer attachment of the invention are approximately parallel to each other, and are therefore honeycombed with respect to each other, only small bridges of material remain between these strainer apertures, and the total open cross section of all strainer apertures can be significantly increased. Indeed, large total open cross section reduces the flow-through resistance of the strainer attachment of the invention so that auxiliary support parts can be omitted. Additionally, because of the low flow-through resistance of the strainer attachment of the invention, and its large flow throughput, the strainer attachment can be built with such thin walls, that its operation produces comparatively low noise.

Because the thickness of the strainer is minimal in the direction of flow, the formation of an undesirable directed stream characteristics are minimized, so that comparatively simple stream dispersion measures are required.

One type of configuration provides for the ratio of the surface areas of strainer apertures and the connections between them, or the side walls, to be about 4:1 to 1:1, preferably 3:1. On the one hand, this achieves the necessary strainer attachment stability in view of a practically vibration-free operation, and on the other hand it attains the largest possible passage cross section.

An indentation of the strainer attachment is additionally prevented, even under heavy water pressure or high temperatures, by giving the strainer attachment a convex or conical shape with the central portion extending toward the upstream side.

It is advantageous if the inflow and/or outflow edges on the side walls of the strainer apertures are rounded. Rounded edges on the inflow side additionally favor low flow-through resistance of the strainer attachment of the invention. The individual streams are able to flow linearly on the outflow side of the rounded edges, which additionally obviates any turbulence in these individual streams and the corresponding noise.

In the manufacture of the one-piece plastic strainer of the invention, plastic may flow into the mold in the area of the conical point or top of the dome. This achieves particularly uniform distribution of the injected plastic, which also enables the manufacture of thin common wall structures.

The strainer attachment of the invention can also be located in the outflow direction of a water outlet fitting. The advantages of the strainer attachment of the invention are specially evident when the strainer attachment is placed upstream of a check valve, a water flow regulator, a throttle part or similar built-in component for water outlet fittings, especially a jet regulator.

In order to easily attach the strainer to the corresponding built-in part so that it can be removed, a preferred configuration of the invention provides for the strainer attachment to have a peripheral collar band with an inwardly facing locking groove thereabout or similar stop cutout, and that this groove at least one inward flange or similar stopping means for a removable attachment into a fixture in the flow line.

BRIEF DESCRIPTION OF THE DRAWINGS

Other features of the invention are revealed in the following description of a configuration example of the invention, in conjunction with the claims and the drawing. The individual features can be realized by themselves, or several of them in a configuration according to the invention.

DESCRIPTION OF THE PREFERRED EMBODIMENT

Figure 1:
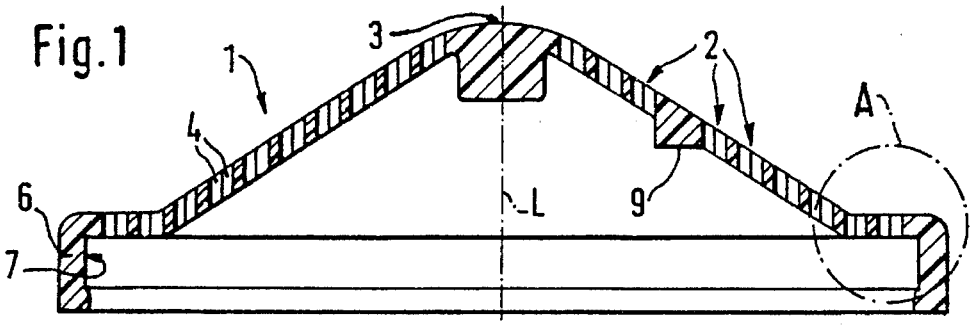
FIG. 1 is a centerline section of a strainer attachment for water outlet fittings.
Figure 2:
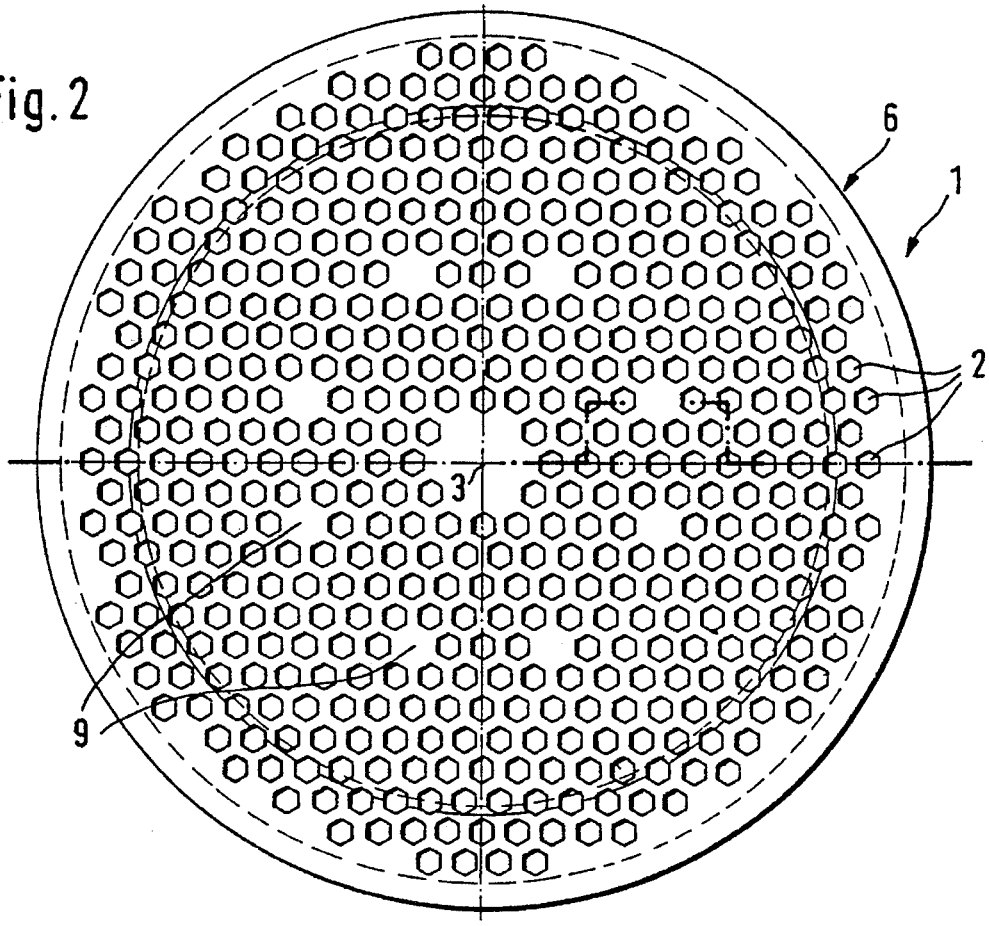
FIG. 2 is a top plan view of the strainer attachment in FIG. 1.
Figure 3:
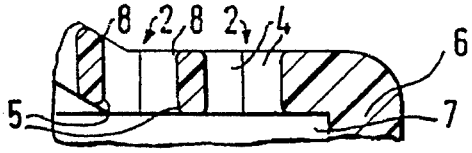
FIG. 3 is an enlarged fragmentary section of the strainer attachment in FIGS. 1 and 2 in the section A area in FIG. 1.

FIGS. 1 to 3 depict a strainer attachment 1 for water outlet fittings, which is used as a protective strainer against clogging of the flow-through openings of downstream built-in parts by dirt particles. The strainer attachment 1 (FIG. 1) has a number of strainer apertures 2, which permit the incoming water to flow through and provide for its cleaning.

All of the strainer apertures 2 have approximately the same hexagonal cross section, and the opposite faces of common side walls of adjacent strainer apertures 2 are approximately parallel to each other. The hexagonal cross sections provide the strainer apertures 2 with a nearly constant aperture radius, which approximates a circular cross section.

When compared to circular holes, however, hexagonal cross section strainer apertures 2 have the advantage that a larger flow-through cross section per surface unit is possible, with a given thickness of strainer. This flow-through cross section can be 50% or more of the strainer's front face, with the usually specified stability ratios. By comparison, circular strainer apertures with the same specifications would only yield about 44% of the aperture cross section.

The mostly constant aperture radius favors good and uniform cleaning of the inflowing water, since no significantly large dirt particles can pass through and affect the built-in parts downstream, even considering the diagonal dimension of the strainer apertures 2. The parallel arrangement of the opposite faces of common side walls of adjacent strainer apertures allow the bridges of material between the strainer apertures to be kept thin, so that the flow-through resistance of the strainer attachment 1 is significantly reduced and its throughput considerably increased.

As can be seen in the centerline section of FIG. 1, the strainer attachment 1 is convex or conical with the high central area upstream. This conical configuration of the strainer attachment 1 in the area of its strainer apertures 2 additionally favors the high stability of the strainer attachment 1. At the same time, the conical shape directs dirt particles reaching the strainer towards the circumference, where they do not impair the flow of the incoming water.

The good throughput of the strainer attachment 1 is also attributable to the fact that the strainer apertures 2 are approximately parallel to the longitudinal strainer axis L. The high throughput of the strainer attachment 1 permits it to be configured without an additional support part, with no fear of any indentation of the strainer due to heavy water pressure or high water temperatures.

Preferably, the strainer attachment 1 is a one-piece plastic injection-molded part. The injection point of this plastic injection-molded part is in the inflow area of the conical point 3.

As is particularly clear from FIG. 3, the outflow edges 5 of the side walls 4, which limit the strainer apertures, are rounded. This rounding of the side walls 4 at their outflow edges 5 allows the individual streams to have a linear flow after passing through the strainer apertures 2, which reduces turbulence in the individual streams and reduces the noise. In order to also reduce the flow-through resistance of the strainer attachment 1 on the inflow side, it can be useful to round off the inflow edges 8 on the side walls 4 in the same way.

The illustrated strainer attachment 1 is versatile for use as a filtering strainer by itself. But it is especially advantageous to use the strainer attachment 1 as a protective strainer, for instance placed in the flow upstream of a check valve, a water flow regulator, a throttle part or similar built-in component for water outlet fittings. A configuration in which the strainer attachment 1 is placed upstream of a jet regulator is especially beneficial.

To connect the strainer attachment 1 on the outflow side to a downstream built-in part so that it can be removed, the strainer attachment 1 has a cup-shaped collar band 6 on its external circumference. As clearly shown in FIG. 1, this collar band has an inwardly facing ring-shaped broad locking groove or similar stop cutout 7 on the inside of the open end area. This acts in conjunction with at least one catch hook or similar stopping means on the inflow front side of the respective built-in part (not shown).

In order to be able to eject the strainer attachment 1 from the injection mold by means of lifters, after the injection molding process, it is advantageous if the strainer attachment 1 has several ejection pads 9, which are located on the outflow side of the inner conical strainer part, uniformly spaced in a circle to correspond to the spacing of the ejection pins in the mold.

The strainer attachment 1 is characterized by low noise, high throughput and at the same time good straining and cleaning action.

Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A strainer attachment for water outlet fittings comprising a one-piece plastic injection-molded part having a front surface and a flow direction therethrough, the strainer attachment being formed of conical shape with apex directed upstream of the flow direction and with strainer apertures which have a passage length measured in the a direction of flow and are of approximately equal open hexagonal aperture cross sections having a maximum measurement transverse to the flow, the total aperture cross section, as compared to the total front surface of the strainer attachment, being greater than about 40%, the passage length of the strainer apertures being less than twice the largest measure of a strainer aperture, and the opposite faces on common side walls of adjacent strainer apertures being approximately parallel to each other, the strainer attachment having a peripheral collar band extending downstream of the flow direction and being formed on its inside surface with a broad inwardly facing recess.

2. A strainer attachment as claimed in claim 1, wherein the ratio of the area of the strainer apertures and the area of the side walls defining them is about 4:1 to 1:1.

3. A strainer attachment as claimed in claim 1, wherein the passage length of the strainer apertures in the flow direction corresponds approximately to the largest dimension of a strainer aperture.

4. A strainer attachment as claimed in claim 1, wherein the edges of side walls of the strainer apertures are rounded on their inflow and outflow sides.

* * * * *